US008477969B2

(12) United States Patent
Epping et al.

(10) Patent No.: US 8,477,969 B2
(45) Date of Patent: Jul. 2, 2013

(54) CONDENSER MICROPHONE

(75) Inventors: Heinz Epping, Hildesheim (DE); Alexander Nowak, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 82 days.

(21) Appl. No.: 13/238,406

(22) Filed: Sep. 21, 2011

(65) Prior Publication Data

US 2012/0099744 A1 Apr. 26, 2012

(30) Foreign Application Priority Data

Oct. 22, 2010 (DE) ..... 10 2010 042 797

(51) Int. Cl.
*H04R 9/08* (2006.01)
*H04R 19/04* (2006.01)
*H04R 21/02* (2006.01)

(52) U.S. Cl.
USPC ..... 381/174; 381/369

(58) Field of Classification Search
USPC ..... 381/355–357, 361, 369, 178, 174, 381/190, 191, 365
See application file for complete search history.

(56) References Cited

U.S. PATENT DOCUMENTS

2009/0129621 A1* 5/2009 Izuchi et al. ..... 381/365

* cited by examiner

*Primary Examiner* — Tuan D Nguyen
(74) *Attorney, Agent, or Firm* — Frommer Lawrence & Haug LLP

(57) ABSTRACT

There is provided a condenser microphone including a microphone capsule having a diaphragm and a capsule mounting, and a sound guide unit for guiding sound. The sound guide unit is provided at at least one side of the capsule mounting.

8 Claims, 6 Drawing Sheets

CONDENSER MICROPHONE

The present application claims priority from German Patent Application Nos. DE 10 2010 042 797.7 filed on Oct. 22, 2010, the disclosure of which is incorporated herein by reference in its entirety.

BACKGROUND OF THE INVENTION

1. Field of the Invention

The present invention concerns a condenser microphone.

2. Description of Related Art

Microphones have long been known and can be in the most widely varying forms. One embodiment is for example a microphone with a lateral sound input. In the case of a microphone with lateral sound input the sound is detected predominantly not from the front but from the side.

Some microphones also have a resonance disk parallel to the diaphragm of the microphone. The disk can then be between a user of the microphone and the diaphragm. That can lead to unwanted shading effects.

SUMMARY OF THE INVENTION

An object of the present invention is to provide an improved microphone having lateral sound input.

Thus there is provided a condenser microphone comprising a microphone capsule having a diaphragm and a capsule mounting, and a sound guide unit for guiding sound. The sound guide unit is provided at at least one side of the capsule mounting.

In an aspect of the invention the microphone has a dome on which the capsule mounting is fixed. The sound guide unit is provided beneath the lower edge of the capsule mounting and above the dome and/or laterally of the capsule Mounting.

In a further embodiment of the invention the sound guide unit is of a flat, concave or convex configuration.

In a further aspect of the invention the sound guide unit is fixed to the microphone capsule, to the capsule mounting and/or to the dome.

In a further aspect of the invention the sound guide unit is adapted to be removable.

The invention concerns the idea of providing a microphone having a sound guide means at at least one side of the microphone capsule, whereby a pressure buildup on the sound guide means can lead to a defined increase in the frequency range of the diaphragm. That can make it possible to enlarge or straighten the frequency response characteristic of such a microphone. The sound guide means serves to better conduct the incident sound to the microphone capsule.

Further configurations of the invention are subject-matter of the appendant claims.

DETAILED DESCRIPTION OF EMBODIMENTS it is to be understood that the figures and descriptions of the present invention have been simplified to illustrate elements that are relevant for a dear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
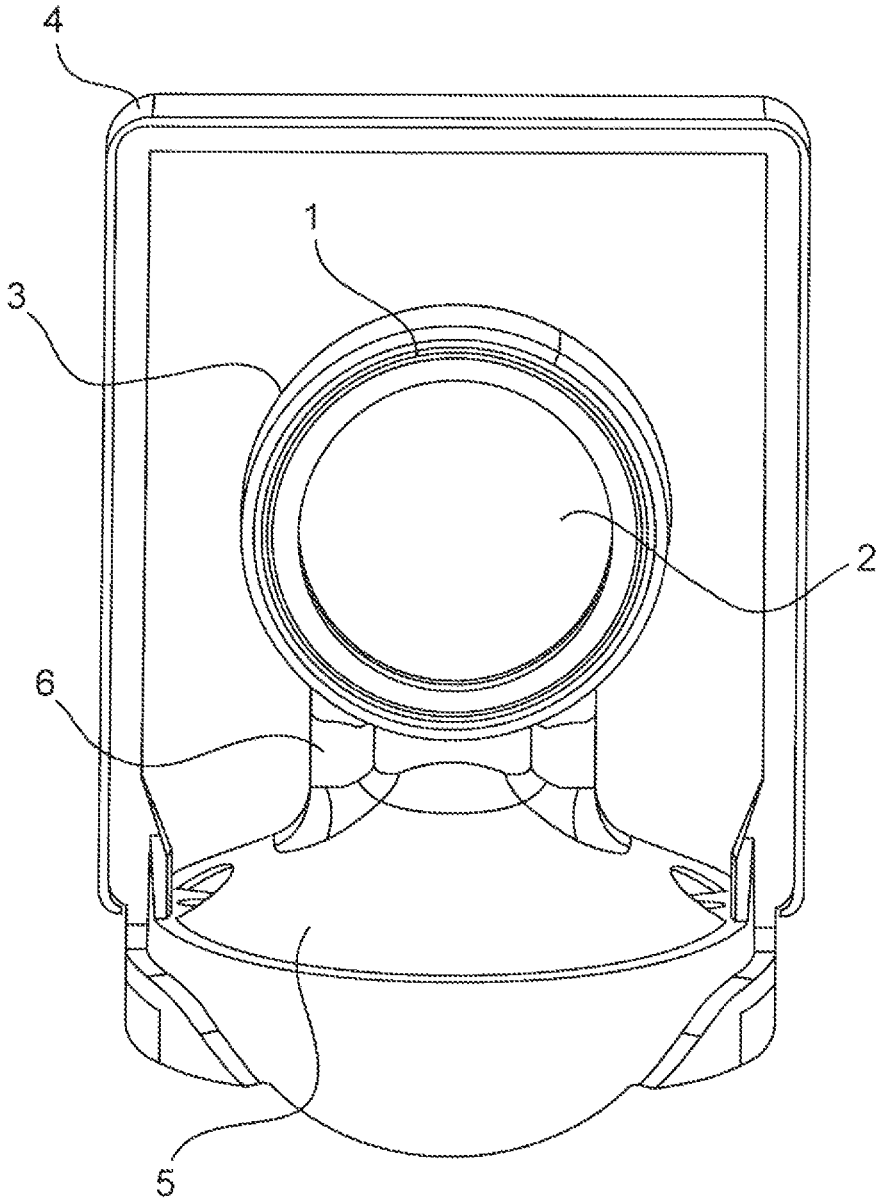
FIG. 1 shows a diagrammatic view of a condenser microphone capsule.

FIG. 1 shows a diagrammatic view of a condenser microphone capsule, in particular showing a condenser microphone capsule for a microphone with lateral sound input. The microphone has a capsule with a diaphragm 2 and a capsule mounting 3. The microphone further optionally has a hoop 4 and optionally a dome 5 for receiving the capsule mounting 3.

Spacers 6 can optionally be provided between the dome 5 and the capsule mounting 3. The microphone capsule 1 is preferably so arranged that delimiting surfaces are arranged in remote relationship. That is intended to prevent troublesome reflection phenomena at the boundary surfaces. In particular the configuration of the dome 5 is intended to serve to pass reflections away from the microphone capsule.

Figure 2:
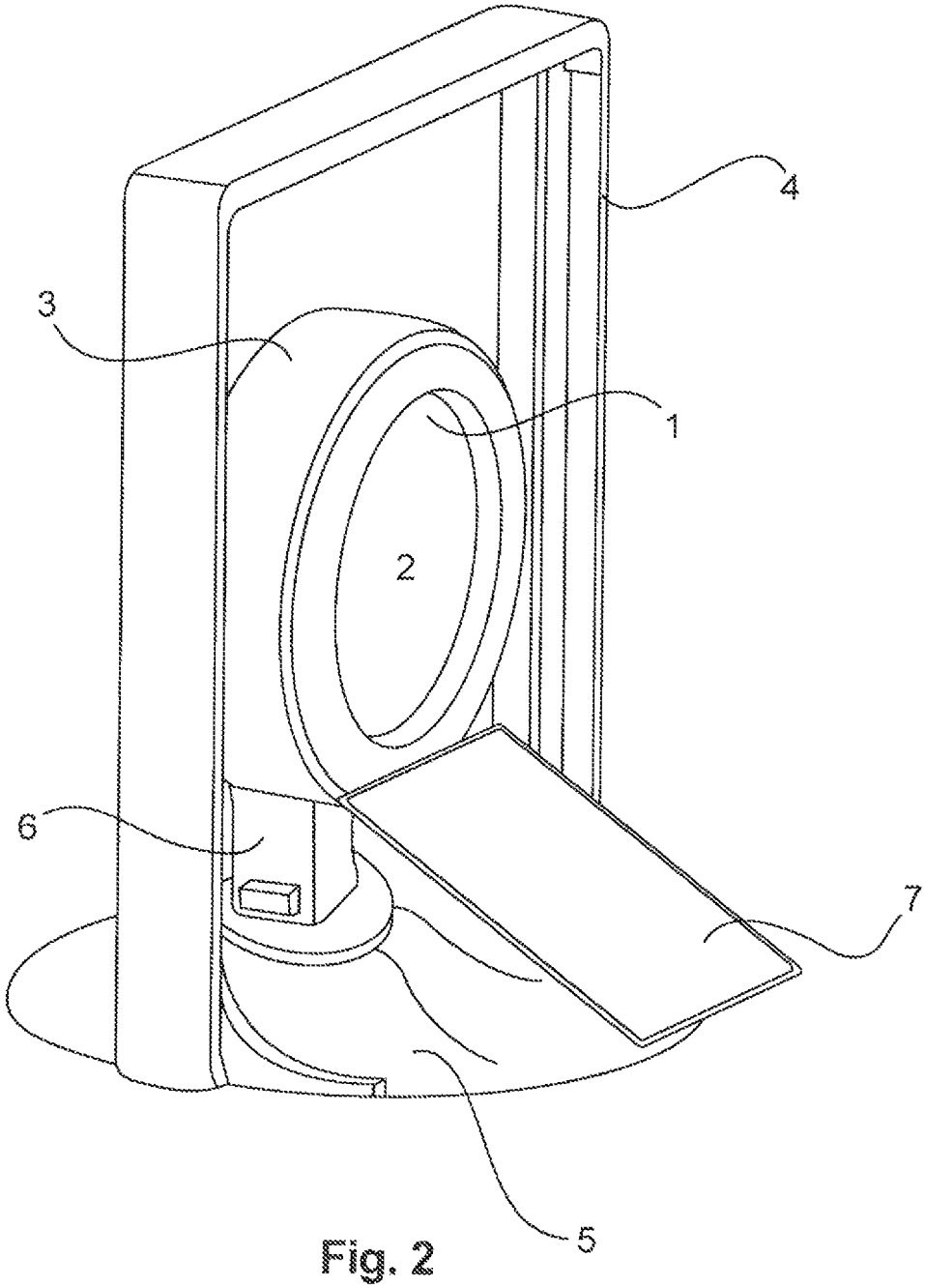
FIG. 2 shows a diagrammatic view of a condenser microphone capsule in first embodiment.

FIG. 2 shows a diagrammatic view of a microphone in a first embodiment. The microphone has a microphone capsule 1 having a diaphragm 2 and a capsule mounting 3 as well as a hoop 4 and a dome 5. In addition thereto there is provided sound guide unit 7 in the region in front of and beneath the microphone capsule 1. Optionally a spacer 6 can be provided between the dome 5 and the capsule mounting. The sound guide unit 7 is positioned in particular at the lower edge of the capsule at a predetermined angle so that the sound guide unit 7 extends downwardly from the lower edge of the capsule 1. The sound guide unit can he for example in the form of a plate and can cover over the region above the dome and below the lower edge of the capsule. The design configuration of the microphone of the first embodiment is advantageous because, if a sound wave is incident on the microphone from the front, the sound wave will also be incident on the sound guide unit 7 and thus there is also a pressure buildup on the sound guide unit 7. The consequence of that can be that certain frequency ranges of the diaphragm are raised.

Figure 3:
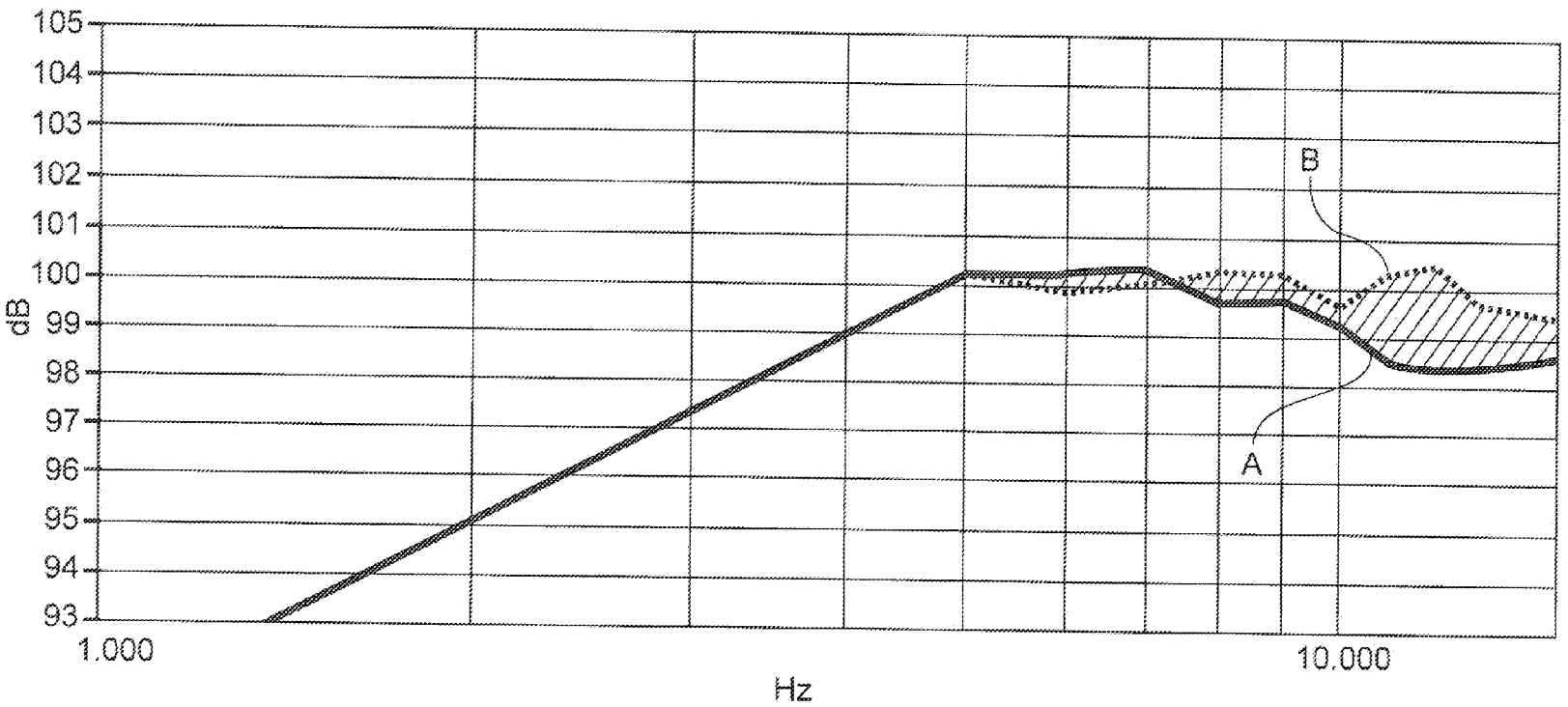
FIG. 3 shows a graph to illustrate the relationship between the frequency and the sound pressure in a microphone in accordance with the first embodiment.

FIG. 3 shows a graph to illustrate the relationship between the frequency and the sound pressure in a microphone according to a first embodiment. The graph A shows the mean value without the sound guide unit and the graph B shows the mean value with the sound guide unit.

Figure 4:
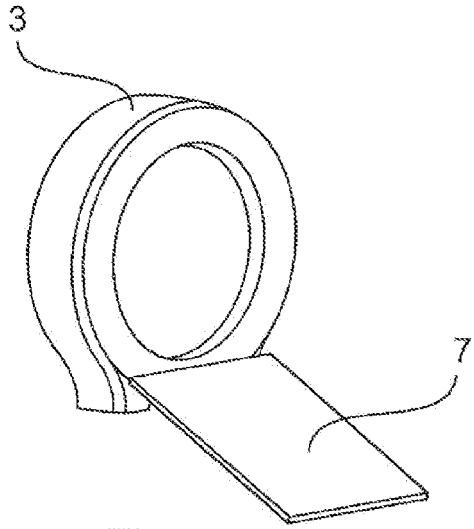
FIGS. 4 through 6 each show a perspective view of a microphone in accordance with the second, third and fourth embodiments.
Figure 5:
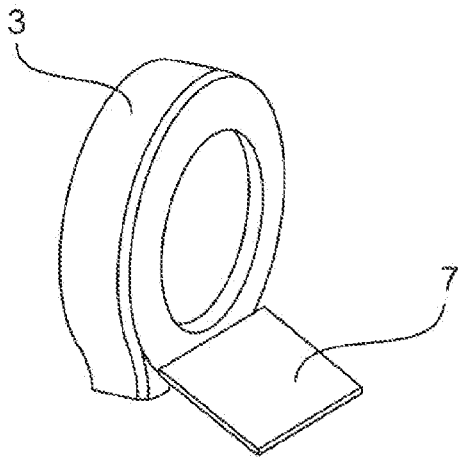
Figure 6:
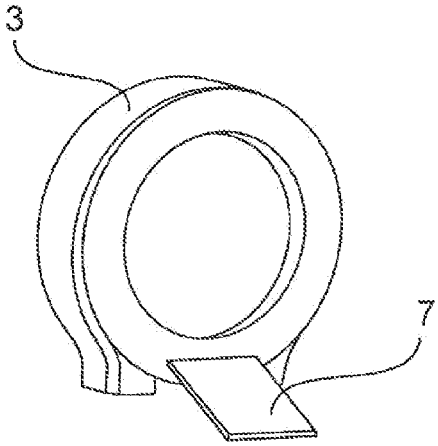

FIGS. 4 through 6 each show perspective views of a microphone capsule and a sound guide unit according to the second, third and fourth embodiments. In this case the sound guide units 7 differ in respect of their size, angle and contour. In that respect the contour can be of a flat, concave or convex configuration.

Figure 7:
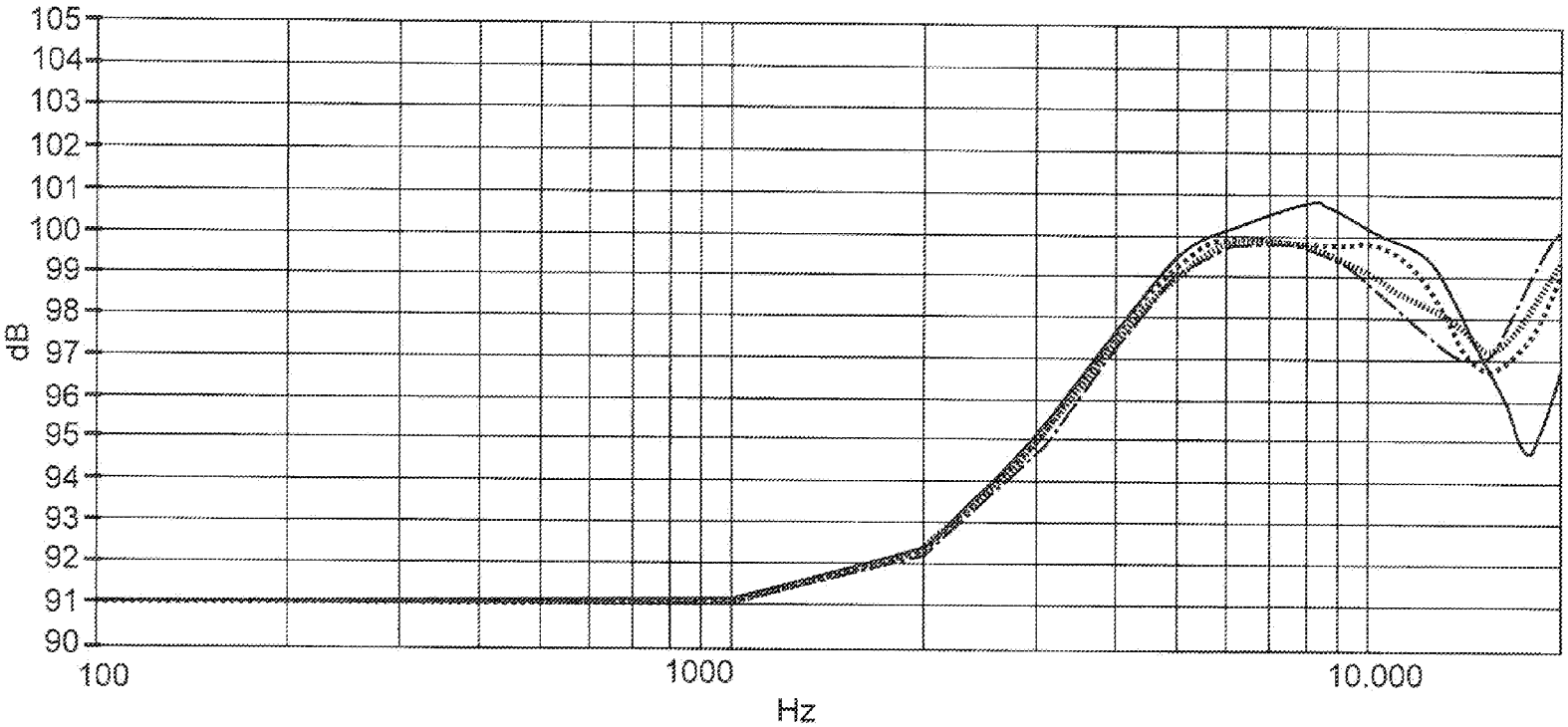
FIG. 7 shows a graph to illustrate the relationship between the frequency and the sound pressure for the microphones in accordance with the second, third and fourth embodiments.

FIG. 7 shows a graph to illustrate the relationship between frequency and sound pressure in the microphones of the second, third and fourth embodiments.

Figure 8:
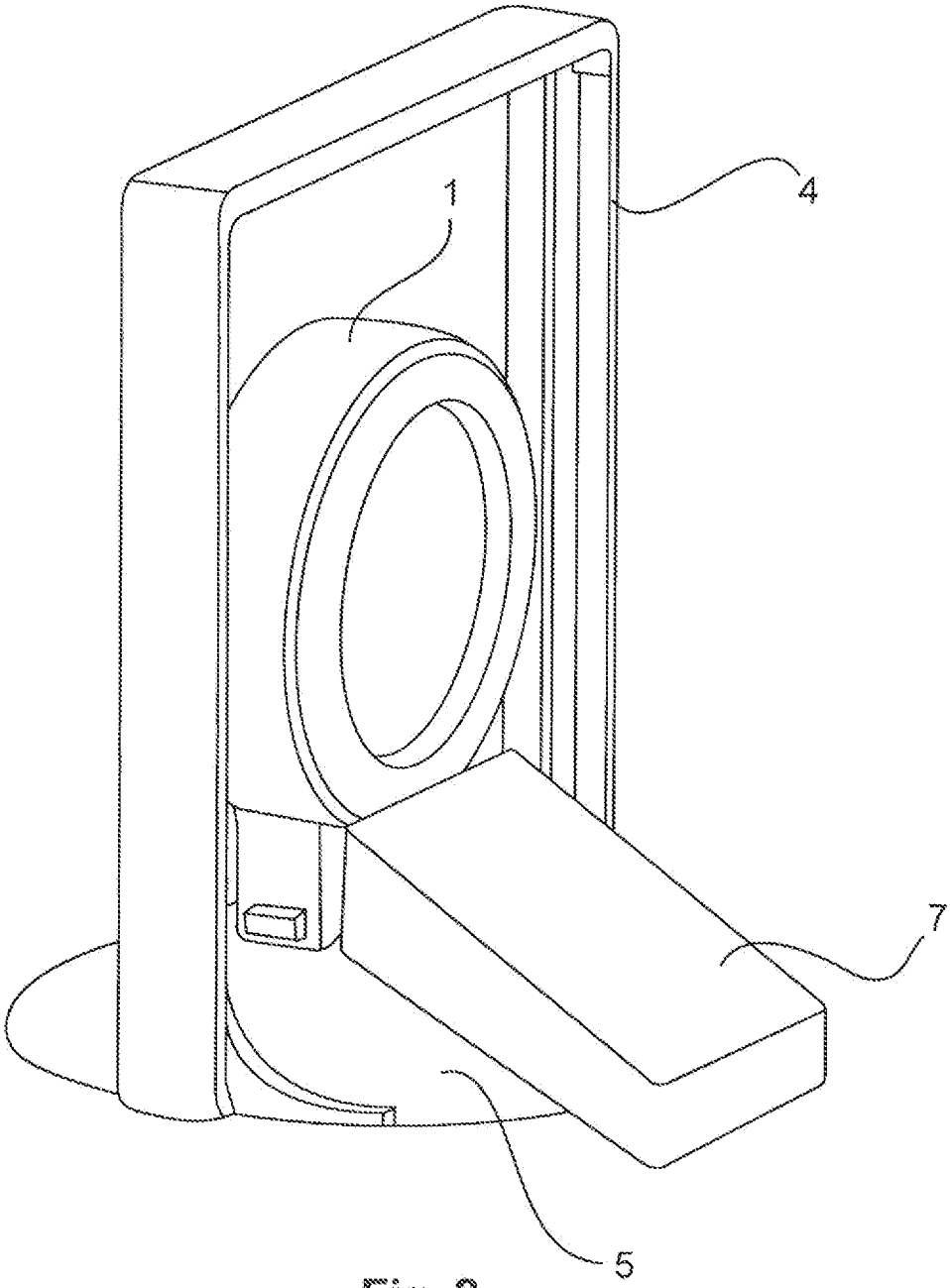
FIG. 8 shows a diagrammatic view of a microphone in accordance with a fifth embodiment of the invention.

FIG. 8 shows a diagrammatic view of a microphone in accordance with the fifth embodiment. In this case the microphone has a microphone capsule 1, optionally a hoop 4, optionally a dome 5 and a sound guide unit 7. The sound guide unit 7 can be fixed to the capsule or to the capsule mounting. As an alternative thereto it can also be integrated into the dome 5.

In a further embodiment of the invention the sound guide unit can also be adapted to be removable. That is advantageous because a user of the microphone can then influence the frequency response characteristic of the microphone by selection of the sound guide unit.

In a further aspect of the invention the sound guide unit 7 is provided in front of the capsule mounting 3. In that case the sound guide unit 7 can be provided beneath the capsule mounting 3 or laterally relative to the capsule mounting. Preferably the sound guide unit 7 is so designed that, when a sound wave is incident on the microphone from the front the sound wave is also incident on the sound guide unit and thus a pressure buildup occurs on the sound guide unit so that given frequency ranges of the diaphragm can be raised.

The dome according to the invention can be of such a configuration that sound reflections are passed away from the microphone capsule.

In other words the configuration and provision of the sound guide unit can lead to a pressure buildup of sound in front of the diaphragm so that given frequency ranges of the diaphragm can be raised.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A condenser microphone comprising:
a microphone capsule including:
a diaphragm; and
a capsule mounting; and
a sound guide unit for guiding sound, the sound guide unit being provided at at least one side or one end of the capsule mounting; and
a dome on which the capsule mounting is fixed;
wherein the sound guide unit is provided:
beneath a lower edge of the capsule mounting and above the dome; and/or
laterally relative to the capsule mounting.

2. The microphone as set forth in claim 1;
wherein the sound guide unit is of a flat, concave, or convex configuration.

3. The microphone as set forth in claim 2;
wherein the sound guide unit is fixed to at least one of the microphone capsule, the capsule mounting, and the dome.

4. The microphone as set forth in claim 3;
wherein the sound guide unit is adapted to be removable.

5. The microphone as set forth in claim 2;
wherein the sound guide unit is adapted to be removable.

6. The microphone as set forth in claim 1;
wherein the sound guide unit is fixed to at least one of the microphone capsule, the capsule mounting, and the dome.

7. The microphone as set forth in claim 6;
wherein the sound guide unit is adapted to be removable.

8. The microphone as set forth in claim 1;
wherein the sound guide unit is adapted to be removable.

* * * * *